US007153174B2

(12) United States Patent
Takada et al.

(10) Patent No.: US 7,153,174 B2
(45) Date of Patent: Dec. 26, 2006

(54) OUTBOARD MOTOR ENGINE SPEED CONTROL SYSTEM

(75) Inventors: Hideaki Takada, Wako (JP); Hiroshi Watabe, Wako (JP); Taiichi Otobe, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 26 days.

(21) Appl. No.: 11/116,816

(22) Filed: Apr. 28, 2005

(65) Prior Publication Data

US 2005/0245145 A1 Nov. 3, 2005

(30) Foreign Application Priority Data

Apr. 30, 2004 (JP) ..... 2004-136126

(51) Int. Cl.
*B63H 21/21* (2006.01)
*F02D 25/02* (2006.01)

(52) U.S. Cl. ..... 440/1; 60/702; 60/706; 440/87

(58) Field of Classification Search ..... 60/700, 60/702, 706
See application file for complete search history.

(56) References Cited

U.S. PATENT DOCUMENTS 3,025,676 A * 3/1962 Millar ..... 60/702
6,233,943 B1 * 5/2001 Beacom et al. ..... 60/706

FOREIGN PATENT DOCUMENTS

JP 08-303269 11/1996

* cited by examiner

*Primary Examiner*—Sherman Basinger
(74) *Attorney, Agent, or Firm*—Carrier, Blackman & Associates, P.C.; Joseph P. Carrier; William D. Blackman

(57) ABSTRACT

An outboard motor engine speed control system includes two outboard motors, sensors which detect a travel speed of the boat and the engine speeds of the outboard motors, and a controller which controls the engine speeds of the outboard motors to be synchronized with a highest one of the detected engine speeds when the boat travel speed is equal to or higher than a predetermined value, while controlling the engine speeds of the outboard motors to be synchronized with a lowest one of the detected engine speeds when the boat travel speed is lower the predetermined value. The operations involved in engine speed control of the outboard motors mounted on the boat are thereby simplified and the feel of operation is enhanced.

14 Claims, 6 Drawing Sheets

OUTBOARD MOTOR ENGINE SPEED CONTROL SYSTEM

CROSS-REFERENCE TO RELATED APPLICATION

This application claims priority under 35 U.S.C. §119 from Japanese Patent Application No. 2004-136126, filed on 30 Apr. 2004, the entire disclosure of which is hereby incorporated by reference.

BACKGROUND OF THE INVENTION

1. Field of the Invention

This invention relates to an outboard motor engine speed control system.

2. Description of the Related Art

When a boat is driven by two or more outboard motors mounted side by side, variance in engine speed among the outboard motors causes differences in thrust that degrade the boat's straight-forwarding (course-holding) ability. Operators have therefore had to synchronize (make equal) the speeds of the internal combustion engines mounted on the outboard motors by regulating them individually. This is a tedious and complex operation. To overcome this inconvenience, outboard motor speed control systems have been developed that detect the engine speeds of the individual outboard motors to determine the outboard motor operating at the highest engine speed and synchronize the engine speeds of the other outboard motor(s) with the highest one.

Further, Japanese Laid-Open Patent Application No. Hei 8(1996)-303269 teaches a technique for the motors whose engines are switched between full-cylinder operation (during which all of the cylinders are supplied with fuel to be operative) and cut-off cylinder operation (during which the fuel supply to some of the engine cylinders are cut off or stopped to be non-operative). In the technique, the timing of implementing the cut-off cylinder operation is synchronized among the motors so that at the time switchover between the cut-off cylinder operation and full-cylinder operation, no variance in thrust arises among the outboard motors.

Another widely adopted practice is to utilize outboard motor speed differentiation positively for improving boat turning performance.

When, as in the prior art, the engine speeds of multiple outboard motors are detected and all of the outboard motor engine speeds are synchronized with the highest speed, all outboard motors come to be synchronized on the highest thrust. This degrades the feel of operation because it gives the operator an unnatural feeling when low-speed is required, such as during trolling.

Further, in order to utilize outboard motor speed differentiation positively for improving boat turning performance, it is necessary for the operator to manually disable engine speed synchronization control. As this complicates operation, there is room for improvement. It should also be noted that the technique taught by the foregoing patent application does not offer a solution for this issue because it takes into consideration only variance in thrust occurring at switchover between cut-off cylinder operation and full-cylinder operation.

SUMMARY OF THE INVENTION

An object of the present invention is therefore to overcome the foregoing drawbacks by providing an outboard motor engine speed control system that simplifies the operations involved in engine speed control of the outboard motors mounted on a boat and enhances the feel of operation.

In order to achieve the object, the present invention provides a system for controlling speeds of internal combustion engines of outboard motors each adapted to be mounted on a stern of a boat and catch having a propeller with a rudder powered by the engine to propel and steer the boat, comprising: a sensor for detecting a parameter indicative of a travel speed of the boat; engine speed sensors each installed at the engines and detecting a parameter indicative of engine speeds of the outboard motors; and an engine speed controller implementing a synchronization control to control the engine speeds of the outboard motors to be synchronized with a highest one of the detected engine speeds when the travel speed parameter is equal to or higher than a predetermined value, while controlling the engine speeds of the outboard motors to be synchronized with a lowest one of the detected engine speeds when the travel speed parameter is lower than the predetermined value.

BRIEF DESCRIPTION OF THE DRAWINGS

The above and other objects and advantages of the invention will be more apparent from the following description and drawings in which.

DETAILED DESCRIPTION OF THE SELECTED ILLUSTRATIVE EMBODIMENT

Here follows a description of a selected illustrative embodiment of an outboard motor engine speed control system according to the invention made with reference to the appended drawings.

Figure 1:
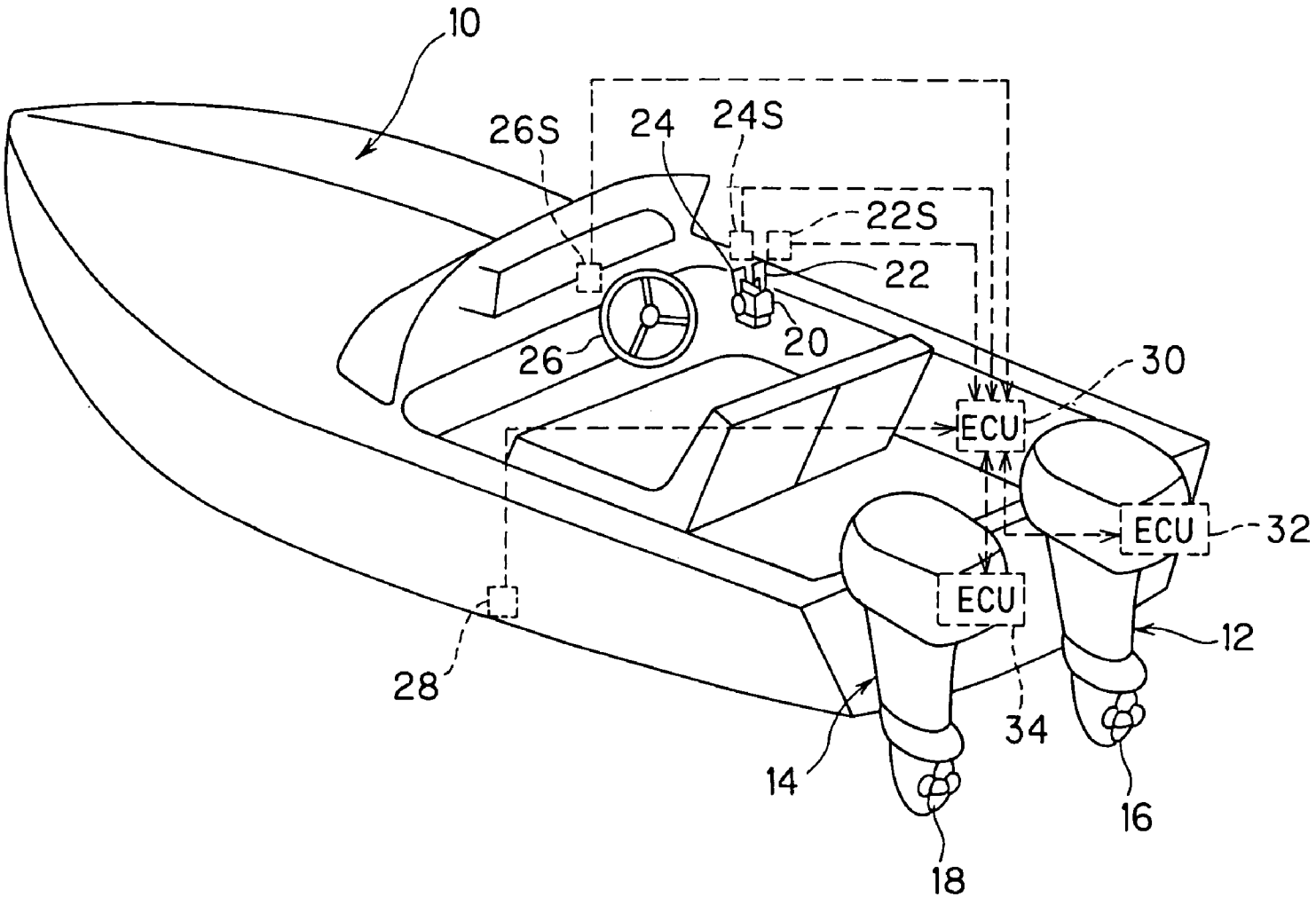
FIG. 1 is an overall schematic view of an outboard motor engine speed control system according to an embodiment of the invention, with primary focus on the outboard motor.

FIG. 1 is an overall schematic view of an outboard motor engine speed control system according to the embodiment of the invention, with primary focus on the outboard motors thereof.

As shown in FIG. 1, a plurality of, more specifically two outboard motors are mounted at the stem of a hull (boat) 10. The boat 10 thus has what is called a dual motor configuration. In the following, the outboard motor designated by the symbol 12 in the drawings (the outboard motor on the right (starboard) side relative to the direction forward travel) will be called the "first outboard motor" and that designated by the symbol 14 (the one on the left (port) side) will be called the "second outboard motor."

The first and second outboard motors 12, 14 are equipped with internal combustion engines (not shown in FIG. 1) at the top (in the gravitational direction) and with propellers 16, 18 at the bottom. The propellers 16, 18 which operate to propel the boat 10 in the forward and reverse directions, are rotated by power transmitted from the engines.

A remote control box 20 mounted near the operator's seat of the boat 10 is equipped with two shift-throttle levers. In the following, the shift-throttle lever designated by the symbol 22 in the drawings (the lever on the right (starboard) side relative to the direction forward travel) will be called the "first shift-throttle lever" and that designated by the symbol 24 (the one on the left (port) side) will be called the "second shift-throttle lever."

A first shift-throttle lever sensor 22S installed near the first shift-throttle lever 22 outputs a signal corresponding to the position P1 to which the operator sets the first shift-throttle lever 22. A second shift-throttle lever sensor 24S installed near the second shift-throttle lever 24 outputs a signal corresponding to the position to which the operator sets the second shift-throttle lever 24.

A steering wheel 26 is installed near the operator's seat. A steering angle sensor 26S installed near the steering wheel 26 outputs a signal corresponding to the steering angle θstr to which the operator turns the steering wheel 26. A boat speed sensor (speedometer) 28 installed at an appropriate location on the boat 10 outputs a signal corresponding to the speed V of the boat 10.

A main ECU (Electronic Control Unit) 30 comprising a microcomputer is installed at an appropriate location on the boat 10. The outputs of the aforesaid sensors are sent to the main ECU 30. In addition, the main ECU 30 can communicate with an ECU (Electronic Control Unit) 32 also comprising a microcomputer that is provided in the first outboard motor 12 (hereinafter called the "first outboard motor ECU") and an ECU (Electronic Control Unit) 34 also comprising a microcomputer that is provided in the second outboard motor 14 (hereinafter called the "second outboard motor ECU").

Figure 2:
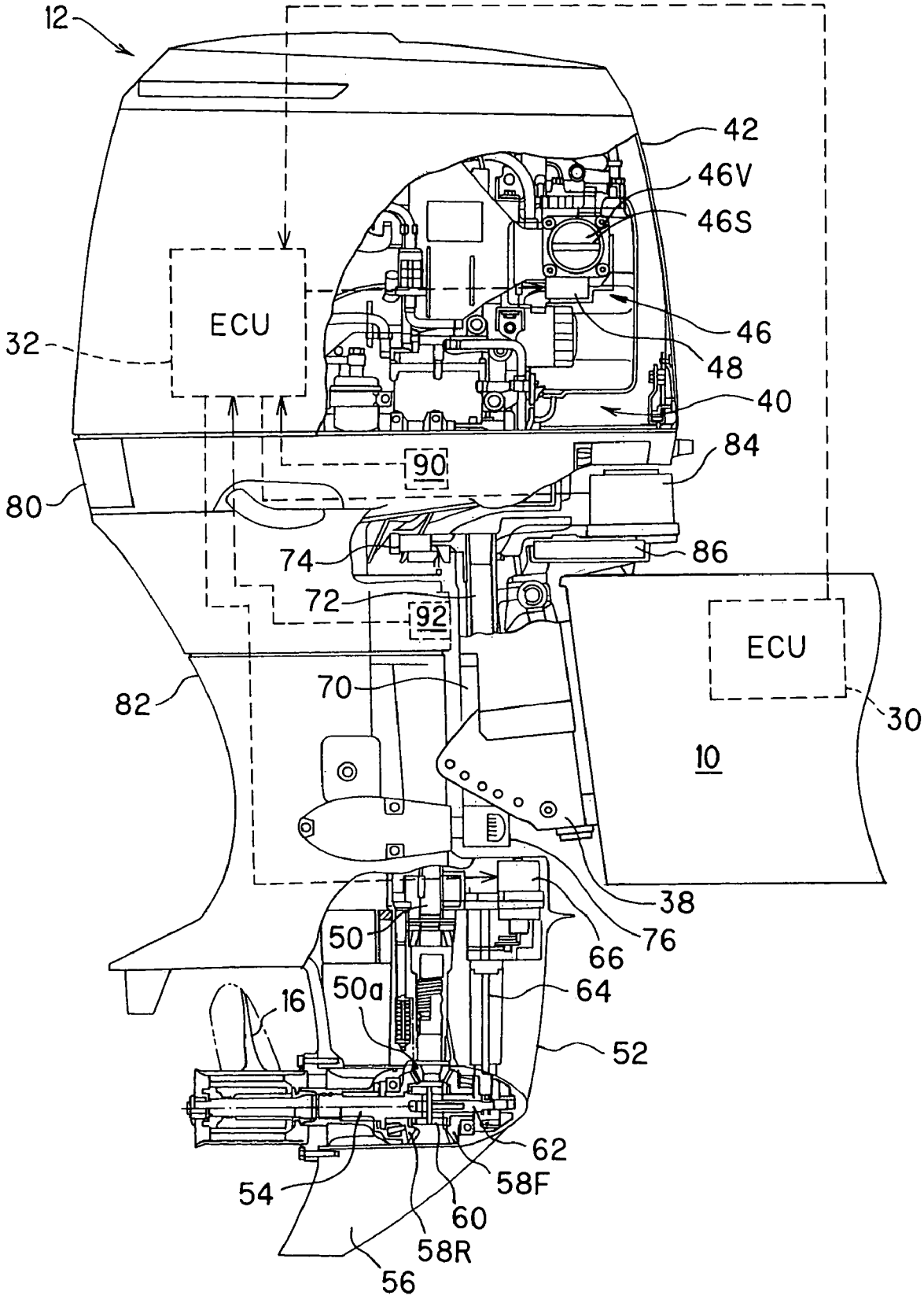
FIG. 2 is an enlarged explanatory view of a first outboard motor shown in FIG. 1.

FIG. 2 is an enlarged explanatory view of the first outboard motor 12. The first outboard motor 12 will now be explained with reference to FIG. 2. The first outboard motor 12 and second outboard motor 14 are identically configured, so that the following explanation also applies to the second outboard motor 14.

As shown in FIG. 2, the first outboard motor 12 is mounted on the stem of the boat 10 via stem brackets 38. The first outboard motor 12 is equipped at its upper portion with the internal combustion engine (now assigned with reference numeral 40). The engine 40 is a spark-ignition, V-type, six-cylinder gasoline engine. The engine 40 is enclosed by an engine cover 42 and positioned above the water surface. The first outboard motor ECU 32 is installed near the engine 40 enclosed by the engine cover 42.

A throttle body 46 is installed in an intake manifold (not shown) of the engine 40. An electric throttle motor 48 is integrally connected with the throttle body 46. The throttle motor 48 and a throttle shaft 46S that supports a throttle valve 46V are interconnected through a gear mechanism (not shown) installed adjacent to the throttle body 46. The speed of the engine 40 is regulated by driving the throttle motor 48 to open and close the throttle valve 46V.

The output of the engine 40 is transmitted, via a crankshaft (not shown) and a vertical shaft 50, to a propeller shaft 54 housed in a gear case 52, and rotates the propeller 16. The gear case 52 is formed integrally with a rudder 56.

A forward gear 58F and a reverse gear 58R are installed around the propeller shaft 54 to mesh with a drive gear 50*a* and be rotated in opposite directions. A clutch 60 that rotates integrally with the propeller shaft 54 is provided between the forward gear 58F and reverse gear 58R. The clutch 60 is connected to an electric shift motor 66 through a shift slider 62 and shift rod 64. When the shift motor 66 is driven, it operates the shift rod 64 and shift slider 62 so as to mesh the clutch 60 with either the forward gear 58F or the reverse gear 58R, thereby selecting the direction of rotation of the propeller 16, i.e., shifting between forward and reverse.

The first outboard motor 12 is equipped with a swivel case 70 connected to the stern brackets 38. The swivel case 70 houses a rotatable swivel shaft 72. The upper end of the swivel shaft 72 is fastened to a mount frame 74 and its lower end is fastened to a lower mount center housing 76. The mount frame 74 and lower mount center housing 76 are fastened to an under cover 80 and an extension case 82 (more exactly, to mounts covered by these members).

An electric steering motor 84 and a gearbox 86 for reducing the output speed of the steering motor 84 are fastened to an upper portion of the swivel case 70. The input side of gearbox 86 is connected to the output shaft of the steering motor 84 and the output side thereof is connected to the mount frame 74. When the steering motor 84 is driven, it rotates the mount frame 74 through the swivel shaft 72, thereby steering the first outboard motor 12.

A crankangle sensor 90 installed near the crankshaft of the engine 40 outputs a crankangle signal once every prescribed angle of rotation, e.g., once every thirty degrees of rotation. A rudder angle sensor 92 installed near the swivel shaft 72 outputs a signal corresponding to the rudder angle θob1 of the first outboard motor 12 (hereinafter called the "first outboard motor rudder angle").

The outputs of the crankangle sensor 90 and rudder angle sensor 92 are sent to the first outboard motor ECU 32. The first outboard motor ECU 32 counts the input pulses sent from the crankangle sensor 90 and calculates the engine speed NE1 of the first outboard motor 12 (hereinafter called the "first outboard motor engine speed") from the count value.

Figure 3:
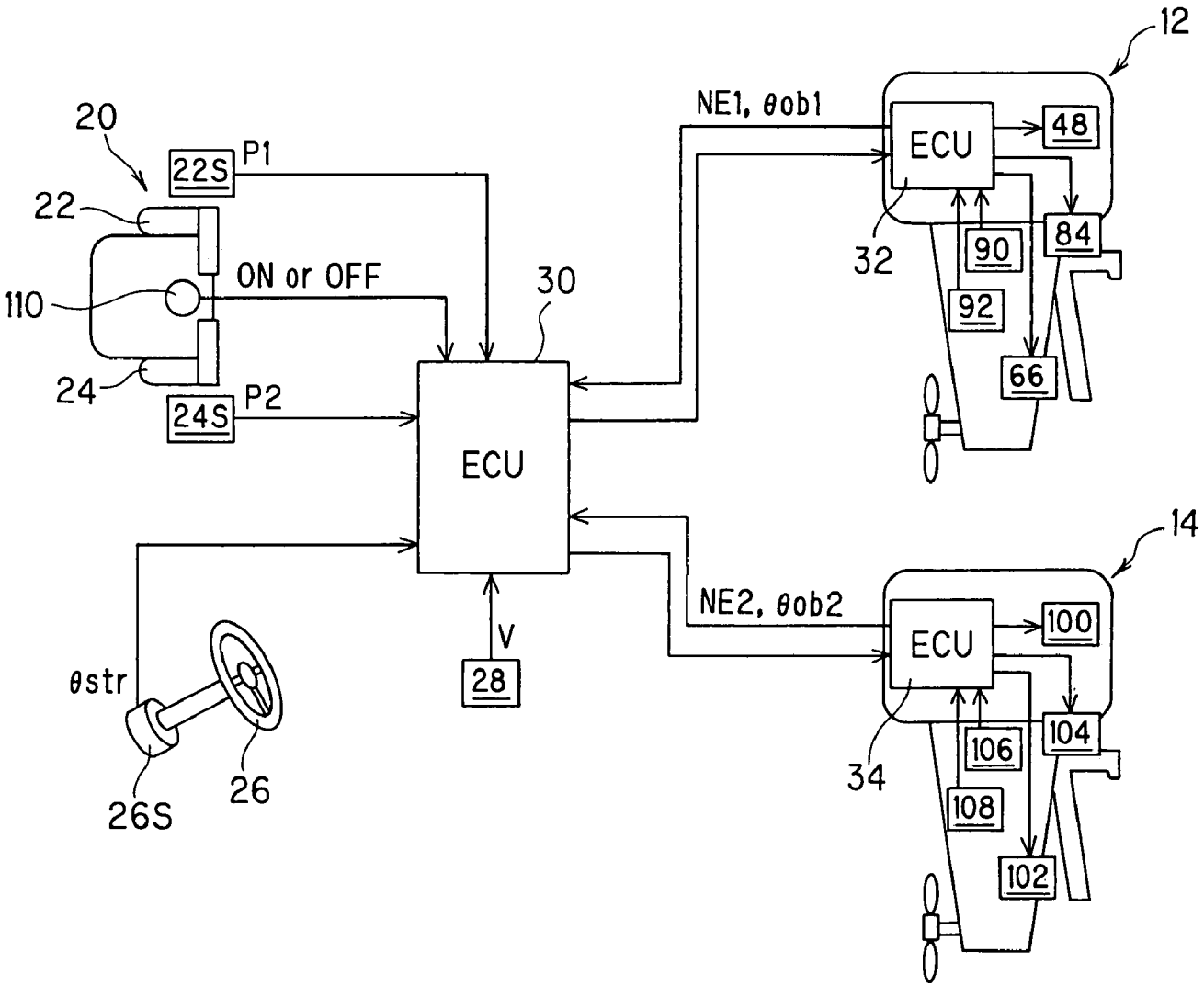
FIG. 3 is a block diagram showing the operation of the outboard motor engine speed control system according to the embodiment of the invention.

FIG. 3 is a block diagram showing the operation of the outboard motor engine speed control system according to the first embodiment of the invention.

In FIG. 3, the throttle motor, shift motor, steering motor, crankangle sensor and rudder angle sensor are designated by the symbols 100, 102, 104, 106 and 108, respectively. The symbol "θob2" designates the rudder angle of the second outboard motor 14 (hereinafter called the "second outboard motor rudder angle") detected by the rudder angle sensor 108, and the symbol NE2 designates the engine speed of the second outboard motor 14 (hereinafter called the "second outboard motor engine speed") that the second outboard motor ECU 34 calculates by counting the output pulses of the crankangle sensor 106. The symbol 110 designates a manual switch provided on the remote control box 20. The manual switch 110 produces an ON or OFF signal when manipulated by the operator.

As shown in FIG. 3, the main ECU 30 is inputted with the steering angle θstr of the steering wheel 26, the boat speed V, the first outboard motor engine speed NE1, the second outboard motor engine speed NE2, the first outboard motor rudder angle θob1, the second outboard motor rudder angle θob2 and the ON-OFF signal of the manual switch 110.

Based on the inputted values, the main ECU 30 controls to operate the throttle motor 48, shift motor 66 and steering motor 84 mounted on the first outboard motor 12, as well as the throttle motor 100, shift motor 102 and steering motor 104 mounted on the second outboard motor 14, thereby running the boat 10.

Specifically, the main ECU 30 controls to drive the shift motor 66 in response to the direction of first shift-throttle lever 22 manipulation (tilting) to select the direction (forward or reverse) of the thrust produced by the first outboard motor 12, and controls to drive the throttle motor 48 in response to the amount of manipulation of the lever 22 to regulate the throttle opening, i.e., the first outboard motor engine speed NE1 (and thus the thrust).

Similarly, the main ECU 30 controls to drive the shift motor 102 in response to the direction of second shift-throttle lever 24 manipulation (tilting) to select the direction (forward or reverse) of the thrust produced by the second outboard motor 14, and controls to drive the throttle motor 100 in response to the amount of manipulation of the lever 24 to regulate the throttle opening, i.e., the second outboard motor engine speed NE2 (and thus the thrust).

Further, the main ECU 30 controls to drive the steering motors 84, 104 mounted on the first and second outboard motors 12, 14 based on the steering angle θstr of the steering wheel 26 so as to turn the first and second outboard motors 12, 14 clockwise or counterclockwise, thereby steering the boat 10 left (port) or right (starboard). The control signals sent out from the main ECU 30 are supplied to the motors through the first outboard motor ECU and second outboard motor ECU.

Further, the main ECU 30 controls to drive the throttle motors 48, 100 based on the first outboard motor engine speed NE1, second outboard motor engine speed NE2, first outboard motor rudder angle θob1 and second outboard motor rudder angle θob2 so as to synchronize (make equal) the first outboard motor engine speed NE1 and second outboard motor engine speed NE2 or to differentiate them positively (deliberately).

The operation of the outboard motor speed control system according to this embodiment will now be explained with reference to FIG. 4. Specifically, explanation will be made regarding the processing operations executed for synchronizing the first outboard motor engine speed NE1 and second outboard motor engine speed NE2 and also those for establishing a difference therebetween.

Figure 4:
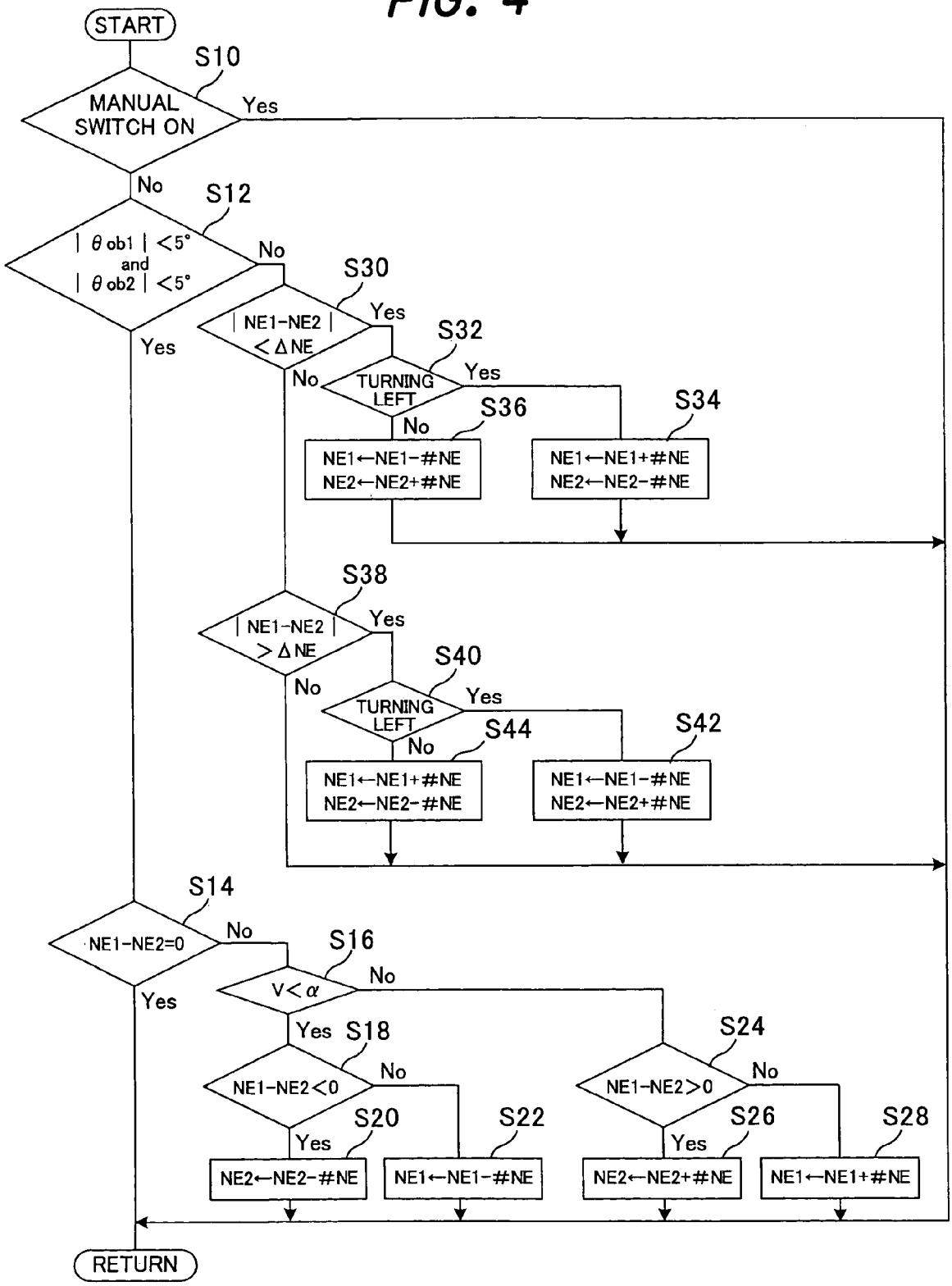
FIG. 4 is a flowchart similarly showing the sequence of operations of the outboard motor engine speed control system according to the embodiment of the invention.

FIG. 4 is a flowchart showing the sequence of the operations. The routine of flowchart is activated once every few milliseconds.

First, in S10, it is determined whether the manual switch 110 is outputting an ON signal. When the result in S10 is YES, i.e., when it is determined that the operator has an intention to manually operate the outboard motors, the remaining steps of the routine are skipped.

When the result in S10 is NO, a determination is made in S12 as to whether the absolute values of the first outboard motor rudder angle θob1 and second outboard motor rudder angle θob2 are smaller than a predetermined value (5 degrees). This amounts to determining whether the boat 10 is moving forward.

When the result in S12 is YES, i.e., when the boat 10 is determined to be moving forward, a determination is made in S14 as to whether the value obtained by subtracting the second outboard motor engine speed NE2 from the first outboard motor engine speed NE1 is zero. When the result in S14 is YES, i.e., when it is determined that there is no difference between the first outboard motor engine speed NE1 and second outboard motor engine speed NE2, the remaining steps of the routine are skipped. When the result in S14 is NO, i.e., when the engine speeds are determined to be different, a determination is made in S16 as to whether the boat speed V is lower than a predetermined value a (e.g., 20 km/h). This amounts to determining whether the boat 10 is traveling at low speed.

When the result in S16 is YES, i.e., when the boat is traveling at low speed, a determination is made in S18 as to whether the value obtained by subtracting the second outboard motor engine speed NE2 from the first outboard motor engine speed NE1 is less than zero, i.e., whether the second outboard motor engine speed NE2 exceeds the first outboard motor engine speed NE1.

When the result in S18 is YES, the program proceeds to S20, in which the second outboard motor engine speed NE2 is reduced by a predetermined value #NE. When the result in S18 is NO, i.e., when the first outboard motor engine speed NE1 is found to exceed the second outboard motor engine speed NE2, the program proceeds to S22, in which the first outboard motor engine speed NE1 is reduced by the predetermined value #NE.

The processing of S20 and S22 are repeated until the first outboard motor engine speed NE1 and second outboard motor engine speed NE2 are synchronized (made equal) to the lower of the two and the result in S14 becomes YES. In other words, when the boat 10 is traveling at low speed, the higher of the engine speeds is synchronized with the lower one (i.e., the engine speeds are synchronized on the low thrust side), thereby maintaining the straight advancing or course-holding ability of the boat 10.

When the result in S16 is NO, i.e., when the boat 10 is found to be traveling at high speed, a determination is made in S24 as to whether the value obtained by subtracting the second outboard motor engine speed NE2 from the first outboard motor engine speed NE1 exceeds zero, i.e., whether the first outboard motor engine speed NE1 exceeds the second outboard motor engine speed NE2.

When the result in S24 is YES, the program proceeds to S26, in which the second outboard motor engine speed NE2 is increased by the predetermined value #NE. When the result in S24 is NO, the program proceeds to S28, in which the first outboard motor engine speed NE1 is increased by the predetermined value #NE.

The processing of S26 and S28 are repeated until the first outboard motor engine speed NE1 and second outboard motor engine speed NE2 are synchronized (made equal) to the higher of the two and the result in S14 becomes YES. In other words, when the boat 10 is traveling at high speed, the lower of the engine speeds is synchronized with the higher one (i.e., the engine speeds are synchronized on the high thrust side), thereby maintaining the straight advancing or course-holding ability of the boat 10.

When the result in S12 is NO, i.e., when boat 10 is found to be turning, a determination is made in S30 as to whether the absolute value obtained by subtracting the second outboard motor engine speed NE2 from the first outboard motor engine speed NE1 is less than a speed difference ΔNE.

Figure 5:
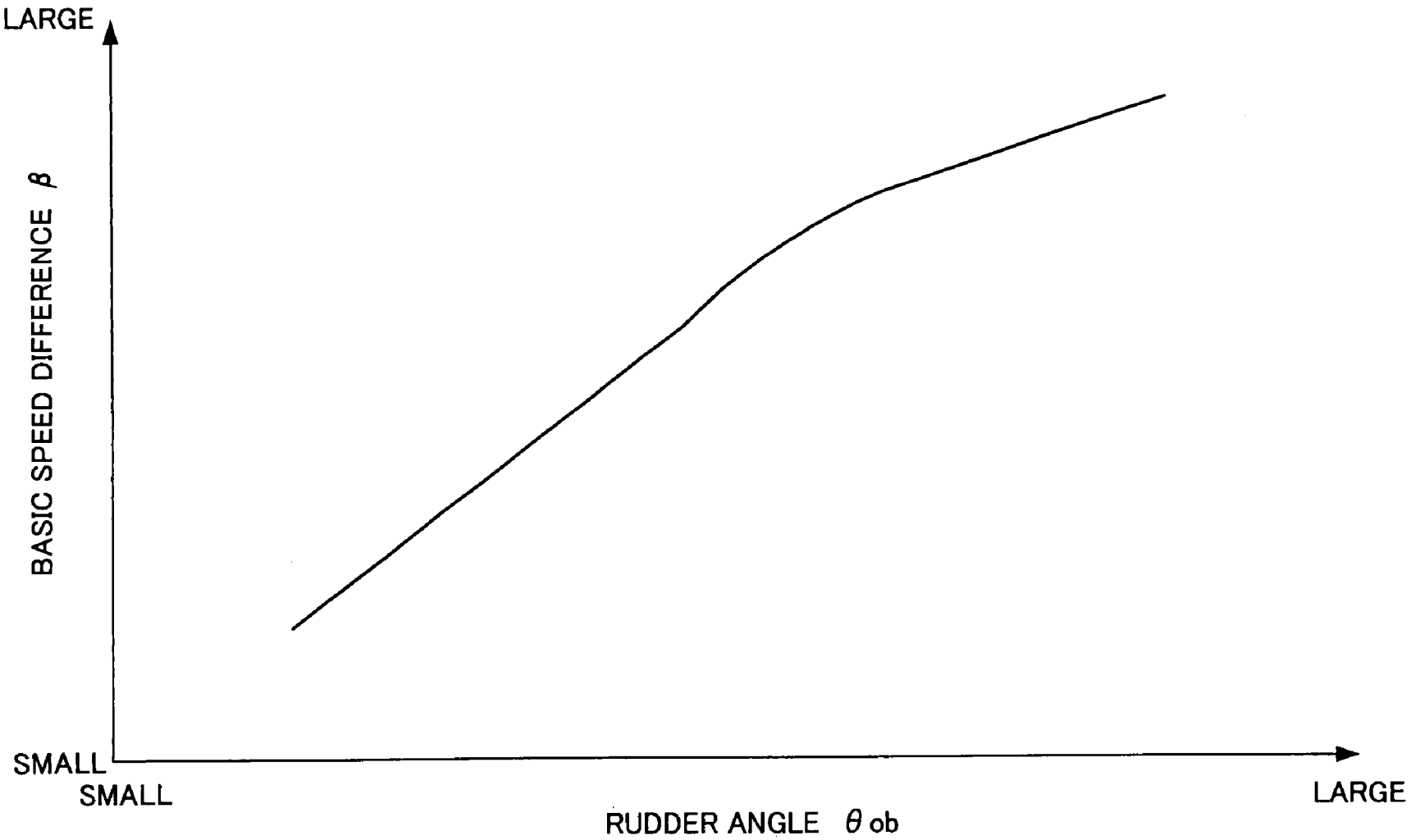
FIG. 5 is a graph showing the characteristic of rudder angle versus basic speed difference referred to in the flowchart of FIG. 4.
Figure 6:
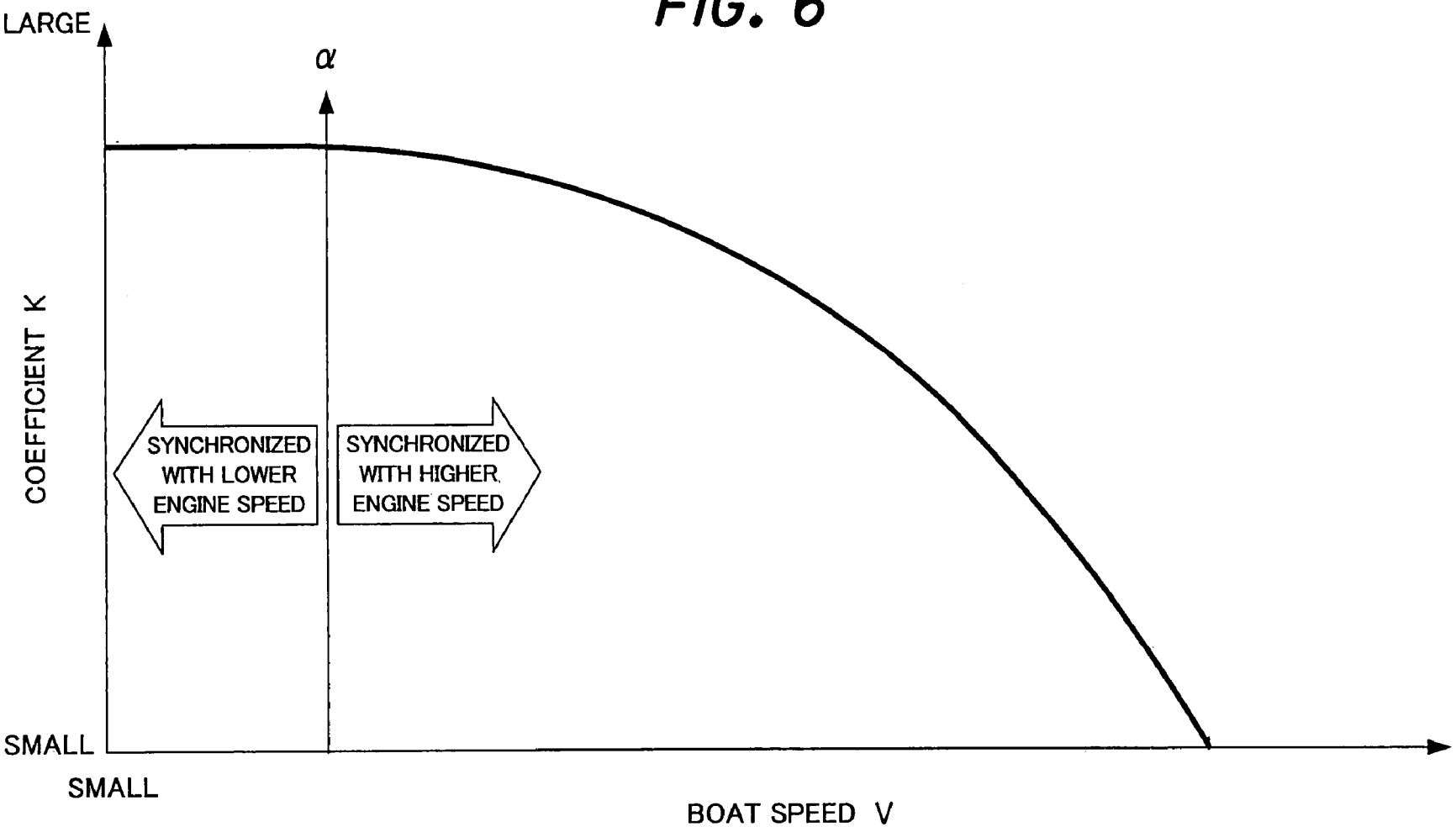
FIG. 6 is a graph showing the characteristic of boat speed versus a coefficient referred to in the flowchart of FIG. 4.

The speed difference ΔNE is calculated as the product of a basic speed difference β determined or defined based on the outboard motor rudder angles θob and a coefficient K determined or defined based on the boat speed V. As shown in FIG. 5, the basic speed difference β is determined or defined to increase with increasing rudder angle θob. Further, as shown in FIG. 6, the coefficient K is determined or defined to decrease with increasing boat speed V. From this it follows that the speed difference ΔNE is larger in proportion as the outboard motor rudder angle θob is greater and the boat speed V is lower, and is smaller in proportion as the outboard motor rudder angle θob is smaller and the boat speed V is higher. The rudder angle θob to be used to determine or define the basic speed difference β can be either the first outboard motor rudder angle θob1 or the second outboard motor rudder angle θob2, or the average of the two.

When the result in S30 is YES, i.e., when the difference between the first outboard motor engine speed NE1 and second outboard engine motor speed NE2 is found to be smaller than the speed difference ΔNE, the program proceeds to S32. In S32, the rudder angle θob is used to determine whether the boat 10 is turning left (port). Here, the value θob can be either the first outboard motor rudder angle θob1 or the second outboard motor rudder angle θob2, or the average of the two.

When it is found in S32 that the boat 10 is turning left (port), the program preceeds to S34, in which the first outboard motor engine speed NE1 is increased by the predetermined value #NE and the second outboard motor engine speed NE2 is reduced by the predetermined value #NE. In other words, the left (port) turning of the boat 10 is assisted by making the engine speed NE1 of the fist outboard motor 12 on the right (starboard) side relative to the direction of travel of the boat 10 larger than the engine speed NE2 of the second outboard motor 14 on the left (port) side.

When the result in S32 is NO, i.e., when starboard turning is found to be in progress, the program proceeds to S36, in which the first outboard motor engine speed NE1 is reduced by the predetermined value #NE and the second outboard motor engine speed NE2 is increased by the predetermined value #NE. In other words, the right (starboard) turning of the boat 10 is assisted by making the engine speed NE2 of the second outboard motor 14 higher than the engine speed NE1 of the first outboard motor 12.

Thus when the result in S12 is NO, meaning that the rudder angle θob of the outboard motors is greater than a predetermined value, i.e., that the boat 10 is turning, synchronization control of the first outboard motor engine speed NE1 and second outboard motor engine speed NE2 is discontinued and turning performance is enhanced by positively establishing a difference between the engine speeds.

The explanation of the flowchart of FIG. 4 will be continued. When the result in S30 is NO, a determination is made in S38 as to whether the value obtained by subtracting the second outboard motor engine speed NE2 from the first outboard motor engine speed NE1 is greater than the speed difference ΔNE.

When the result in S38 is YES, i.e., when it is found that the difference between the first outboard motor engine speed NE1 and second outboard motor engine speed NE2 exceeds the speed difference ΔNE, the program proceeds to S40, in which a determination is made in the manner of that in S32 as to whether the boat 10 is turning left (port). When the result in S40 is YES, the program proceeds to S42, in which the first outboard motor engine speed NE1 is reduced by the predetermined value #NE and the second outboard motor engine speed NE2 is increased by the predetermined value #NE. When the result in S40 is NO, the program proceeds to S44, in which the first outboard motor speed NE1 is increased by the predetermined value #NE and the second outboard motor engine speed NE2 is reduced by the predetermined value #NE.

When the result in S38 is NO, i.e., when the difference between the first outboard motor engine speed NE1 and second outboard motor engine speed NE2 is equal to the speed difference ΔNE, the remaining steps of the routine are skipped.

Thus in outboard motor engine speed control system according to this embodiment, during high-speed running when the boat speed V is equal to or higher than the predetermined value α, the lower of the first outboard motor engine speed NE1 and second outboard motor engine speed NE2 is synchronized with the higher thereof (i.e., the engine speeds are synchronized on the high thrust side), and during low-speed running when the boat speed V is lower than the predetermined value α, the higher of the first outboard motor engine speed NE1 and second outboard motor engine speed NE2 is synchronized with the lower thereof (i.e., the engine speeds are synchronized on the low thrust side). As straight advancing or course-holding ability can therefore be ensured, automatic synchronization of the outboard motor engine speeds NE1 and NE2 becomes feasible, thereby making it possible to simplify operation (operation relating to engine speed control when using two or more outboard motors). In addition, the engine speed at which synchronization is to be achieved, i.e., the desired engine speed is selected between the high thrust side and the low thrust side in response to boat speed, so that the operator has a more pleasant operation experience with no unnatural feeling.

Further, when the rudder angle θob of the outboard motors is greater than the predetermined value (5 degrees), i.e., when the boat 10 is turning, synchronization control of the engine speeds NE1, NE2 is discontinued, making manual disablement of engine speed synchronization control unnecessary and further simplifying operation.

Furthermore, owing to the fact that the speed difference ΔNE is established for differentiating the engine speeds NE1, NE2 when synchronization control of the engine speeds NE1, NE2 is discontinued, the engine speeds can be differentiated automatically during turning to realize simpler operation.

Owing to the fact that the speed difference ΔNE is determined or defined based on the boat speed V and the rudder angle θob, moreover, the engine speeds NE1, NE2 can be suitably controlled in accordance with the running condition, thereby enhancing operation feel.

Specifically, high turning performance matched to the desire of the operator can be achieved because the speed difference ΔNE is determined or defined to increase with increasing rudder angle θob of the outboard motors. At the same time, sharp turning during high-speed running is prevented to enable stable running because the speed difference ΔNE is determined or defined to decrease with increasing boat speed V.

Although the foregoing explanation has been made with regard to the case of using two outboard motors, it is also possible to use three or more outboard motors. In such case, it suffices during low-speed running to synchronize all engine speeds with the lowest among them and during high-speed running to synchronize all engine speeds with the highest among them.

The boat speed sensor 28 has been described as being a speedometer in the foregoing but it is alternatively possible to determine the speed of the boat using GPS (global positioning system) or the like.

Further, whether the boat is traveling at high speed or low speed may be discriminated from the engine speeds rather than from the boat speed V. That is, in S16 of the flowchart of FIG. 4, whether the boat is traveling at low speed or high speed can be determined by determining whether the engine speeds are higher than a predetermined value. It is in this sense that the term "parameter indicative of travel speed of the boat" is recited in the claims mentioned below.

In addition, the discrimination of whether the boat 10 is traveling straight or turning and the discrimination of turning direction has been explained as being made based on the rudder angles θob, but they can instead be made based on the steering angle θstr of the steering wheel 26. It is in this sense that the term "parameter indicative of rudder angle of the boat" is recited in the claims as mentioned.

In S16 of the flowchart of FIG. 4, it is found that the boat is turning when both the first outboard motor rudder angle θob1 and the second outboard motor rudder angle θob2 are 5 degrees or greater. In light of the fact that the two values are almost always the same, however, the discrimination can instead be made using only one or the other of them. It is also possible to use the average of the two values.

The embodiment is thus configured to have a system for controlling speeds of internal combustion engines 40 of outboard motors (first outboard motor 12, second outboard motor 14) each mounted on a stern of a boat 10 and each having a propeller 16 (18) with a rudder powered by the engine to propel and steer the boat, comprising: a sensor (boat speed sensor (speedometer)) 28 for detecting a parameter indicative of a travel speed V of the boat; engine speed sensors (crankangle sensors 90, 106) each installed at the engines and detecting a parameter indicative of engine speeds NE1, NE2 of the outboard motors; and an engine speed controller (main ECU 30, S26, S28, S20, S22) implementing a synchronization control to control the engine speeds of the outboard motors to be synchronized with a highest one of the detected engine speeds when the parameter is equal to or higher than a predetermined value α, while controlling the engine speeds of the outboard motors to be synchronized with a lowest one of the detected engine speeds when the parameter is lower the predetermined value.

The system further includes: a senor (rudder angle sensor 92, 108) for detecting a parameter indictive of a rudder angle θob1, θob2 of the outboard motor, and the engine speed controller discontinues the synchronization control when the detected parameter is equal to or greater than a predetermined value of the rudder angle(S12, S30 to S42).

In the system, the engine speed controller controls the engine speeds to be differentiated with each other when the detected rudder angle parameter is equal to or greater than a predetermined valve (5 degrees) (S30 to S42).

In the system, the engine speed controller controls the engine speeds to be differentiated with each other by at least a predetermined speed difference ΔNE when the detected rudder angle parameter is equal to or greater than a predetermined value (5 degrees).

In the system, the speed difference is determined based on the travel speed V of the boat and rudder angle θob1, θob2 of the outboard motor.

In the system, the speed difference is determined to increase with increasing rudder angle θob1, θob2 of the outboard motor, or the speed difference is determined to decrease with increasing travel speed V of the boat.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling speeds of internal combustion engines of outboard motors each adapted to be mounted on a stern of a boat and each having a propeller with a rudder powered by the engine to propel and steer the boat, comprising:

a sensor for detecting a parameter indicative of a travel speed of the boat;

engine speed sensors each installed at the engines and detecting a parameter indicative of engine speeds of the outboard motors; and an engine speed controller implementing a synchronization control to control the engine speeds of the outboard motors to be synchronized with a highest one of the detected engine speeds when the travel speed parameter is equal to or higher than a predetermined value, while controlling the engine speeds of the outboard motors to be synchronized with a lowest one of the detected engine speeds when the travel speed parameter is lower than the predetermined value.

2. The system according to claim 1, further comprising:

a sensor for detecting a parameter indicative of a rudder angle of at least one of the outboard motors;

and the engine speed controller discontinues the synchronization control when the detected rudder angle parameter is equal to or greater than the predetermined value.

3. The system according to claim 2, wherein the engine speed controller controls the engine speeds to be differentiated with each other when the detected rudder angle parameter is equal to or greater than the predetermined value.

4. The system according to claim 3, wherein the engine speed controller controls the engine speeds to be differentiated with each other by at least a predetermined speed difference when the detected rudder angle parameter is equal to or greater than the predetermined value.

5. The system according to claim 4, wherein the speed difference is determined based on the travel speed of the boat and rudder angle of the outboard motor.

6. The system according to claim 5, wherein the speed difference is determined to increase with increasing rudder angle of the outboard motor.

7. The system according to claim 5, wherein the speed difference is determined to decrease with increasing travel speed of the boat.

8. A method of controlling speeds of internal combustion engines of outboard motors each mounted on a stern of a boat and each having a propeller with a rudder powered by the engine to propel and steer the boat, comprising the steps of:

detecting a parameter indicative of a travel speed of the boat;

detecting a parameter indicative of engine speeds of the outboard motors; and implementing a synchronization control to control the engine speeds of the outboard motors to be synchronized with a highest one of the detected engine speeds when the travel speed parameter is equal to or higher than a predetermined value, while controlling the engine speeds of the outboard motors to be synchronized with a lowest one of the detected engine speeds when the travel speed parameter is lower than the predetermined value.

9. The method according to claim 8, further including the step of:

detecting a parameter indicative of a rudder angle of at least one of the outboard motors;

and the step of engine speed controlling discontinues the synchronization control when the detected rudder angle parameter is equal to or greater than the predetermined value.

10. The method according to claim 8, wherein the step of engine speed controlling controls the engine speeds to be differentiated with each other when the detected rudder angle parameter is equal to or greater than the predetermined value.

11. The method according to claim 8, wherein the step of engine speed controlling controls the engine speeds to be differentiated with each other by at least a predetermined speed difference when the detected rudder angle parameter is equal to or greater than the predetermined value.

12. The method according to claim 11, wherein the speed difference is determined based on the travel speed of the boat and rudder angle of the outboard motor.

13. The method according to claim 12, wherein the speed difference is determined to increase with increasing rudder angle of the outboard motor.

14. The method according to claim 12, wherein the speed difference is determined to decrease with increasing travel speed of the boat.

* * * * *